US011426616B1

(12) United States Patent
Chen et al.

(10) Patent No.: US 11,426,616 B1
(45) Date of Patent: Aug. 30, 2022

(54) CARRIER DEVICE SET AND FIREFIGHTING MOTORCYCLE USING SAME

(71) Applicant: SHIH CHANG MOTORCYCLE CO., LTD., Taichung (TW)

(72) Inventors: Chiu-Ching Chen, Taichung (TW); Rui-Bin Chen, Taichung (TW)

(73) Assignee: SHIH CHANG MOTORCYCLE CO., LTD., Taichung (TW)

( * ) Notice: Subject to any disclaimer, the term of this patent is extended or adjusted under 35 U.S.C. 154(b) by 0 days.

(21) Appl. No.: 17/672,008

(22) Filed: Feb. 15, 2022

(30) Foreign Application Priority Data

Apr. 28, 2021 (TW) ..... 110115390

(51) Int. Cl.
*A62C 27/00* (2006.01)
*A62C 13/78* (2006.01)

(52) U.S. Cl.
CPC ..... *A62C 27/00* (2013.01); *A62C 13/78* (2013.01)

(58) Field of Classification Search
CPC ..... A62C 27/00; A62C 13/78; A62C 13/003; A62C 13/66; A62C 31/28
USPC ..... 169/52, 24, 30, 71
See application file for complete search history.

(56) References Cited

U.S. PATENT DOCUMENTS

| | | | | |
|---|---|---|---|---|
| 2,418,468 | A * | 4/1947 | Grant, Jr. | A62C 99/0027 169/74 |
| 2,510,861 | A * | 6/1950 | Boal | A62C 99/0027 169/30 |
| 7,216,721 | B2 * | 5/2007 | Jacobson | A62C 13/78 169/44 |
| 7,650,948 | B2 * | 1/2010 | Rousseau | A62C 13/76 340/568.8 |
| 10,576,316 | B1 | 3/2020 | Kulick | |
| 2015/0122514 | A1 * | 5/2015 | Wu | A62C 5/022 169/52 |

FOREIGN PATENT DOCUMENTS

| | | |
|---|---|---|
| TW | M396130 U1 | 1/2011 |
| TW | I421205 B | 1/2014 |

* cited by examiner

*Primary Examiner* — Christopher S Kim
(74) *Attorney, Agent, or Firm* — Birch, Stewart, Kolasch & Birch, LLP

(57) ABSTRACT

A firefighting motorcycle includes a motorcycle body, a carrier device set assembled on the rear of the motorcycle body, a firefighting equipment and a fire extinguishing gun bracket. The firefighting equipment includes a water storage tank, a high-pressure gas cylinder arranged on one side of the water storage tank, and a fire extinguishing gun connected to the water storage tank and the high-pressure gas cylinder through two pipes respectively. The water storage tank is accommodated in the bottom of the long hollow bracket. The fire extinguishing gun bracket is installed on one side of the motorcycle body, so that the fire extinguishing gun of the firefighting equipment is installed on its. The technical features of the firefighting motorcycle and its various components disclosed in the present invention will effectively improve the effectiveness of firefighters who can reach the fire scene and provide rescue in the first time.

10 Claims, 10 Drawing Sheets

CARRIER DEVICE SET AND FIREFIGHTING MOTORCYCLE USING SAME

BACKGROUND OF THE INVENTION

1. Field of the Invention

The present invention relates to public safety technology, especially a firefighting motorcycle with mobility.

2. Description of the Related Art

Generally, the firefighting motorcycle body has a large volume, which makes it impossible for firefighters to arrive at the scene immediately (for example: narrow alleys, mountain roads, congested roads during peak hours of commuting traffic, etc.). At this time, the firefighters carried heavy equipment and fire water line for a certain distance before reaching the scene. In this way, the physical strength of firefighters is really a severe test. Therefore, how to overcome the aforementioned problems is indeed urgent.

SUMMARY OF THE INVENTION

The present invention has been accomplished under the circumstances in view. It is the main object of the present invention to provide a firefighting motorcycle, which comprises a motorcycle body, a carrier device set, a firefighting equipment and a tire extinguishing gun bracket. The technical features of the firefighting motorcycle and its various components disclosed in the present invention will effectively improve the effectiveness of firefighters who can reach the fire scene and provide rescue in the first time.

The carrier device set comprises a carrier, a long hollow bracket and a hydraulic buffer. The carrier comprises a first carrier component, a second carrier component and a connecting member. The first carrier component comprises a plane, and the plane of the first carrier component is formed by a first end with a larger width and a second end with a smaller width connected to the first end. The plane of the first carrier component gradually tapers from the first end of the larger width of the plane of the first carrier component to the second end of the smaller width of the larger width of the plane of the first carrier component. The second carrier component comprises a plane, and the plane of the second carrier component is formed by a first end with a larger width and a second end with a smaller width connected to the first end. The plane of the second carrier component gradually tapers from the first end of the larger width of the plane of the second carrier component to the second end of the smaller width of the larger width of the plane of the second carrier component. The connecting member has two opposite ends thereof respectively protruding toward one same side to form a first coupling portion and a second coupling portion. The first coupling portion and the second coupling portion of the connecting member are respectively connected to the first end of the plane of the first carrier component and the first end of the plane of the second carrier component. The plane of the first carrier component is provided with two supporting portions at intervals. The second carrier component further comprises two mounting portions protruded from the plane thereof. The long hollow bracket is composed of a ring-shaped bottom, a U-shaped back rod and a handle. The U-shaped back rod has two opposite ends thereof respectively connected to one side of the ring-shaped bottom, so that an accommodating space is formed between the ring-shaped bottom and the U-shaped back rod. The positions of the two opposite ends of the U-shaped back rod close to the ring-shaped bottom are respectively provided with an assembly portion. The two assembly portions of the long hollow bracket are respectively pivotally connected to the two mounting portions on the plane of the second carrier component. The handle being set on the U-shaped back rod. The hydraulic buffer has two opposite ends thereof respectively pivotally connected to the connecting member of the carrier and the U-shaped back rod of the long hollow bracket. The first carrier component, second carrier component and connecting member of the carrier device set surround and are assembled at the rear of the motorcycle body. The firefighting equipment of the firefighting motorcycle comprises a water storage task, a high-pressure gas cylinder and a fire extinguishing gun. The high-pressure gas cylinder is arranged on one side of the water storage tank. The fire extinguishing gun is connected to the water storage tank and the high-pressure gas cylinder through two pipes respectively. The water storage tank and the high-pressure gas cylinder are set in the accommodating space of the long hollow bracket of the carrier device set, so that the bottom of the water storage tank is accommodated in the bottom of the long hollow bracket. The fire extinguishing gun bracket is set at one side of the motorcycle body to hold the fire extinguishing gun of the firefighting equipment.

DETAILED DESCRIPTION OF THE INVENTION

Figure 1:
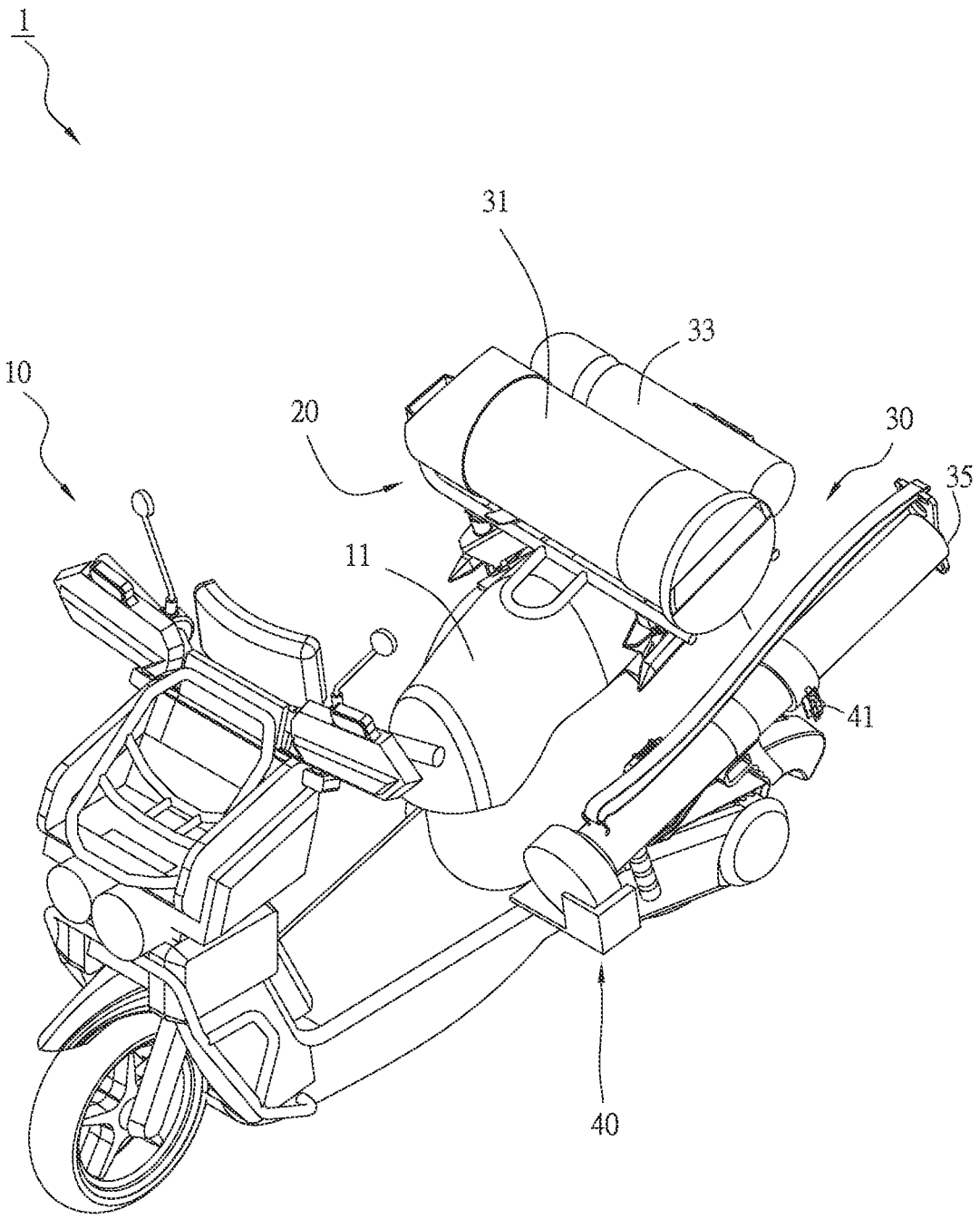
FIG. 1 is a schematic oblique top elevational view of a preferred embodiment of the present invention, which mainly discloses a firefighting motorcycle showing a state before the mission.
Figure 2:
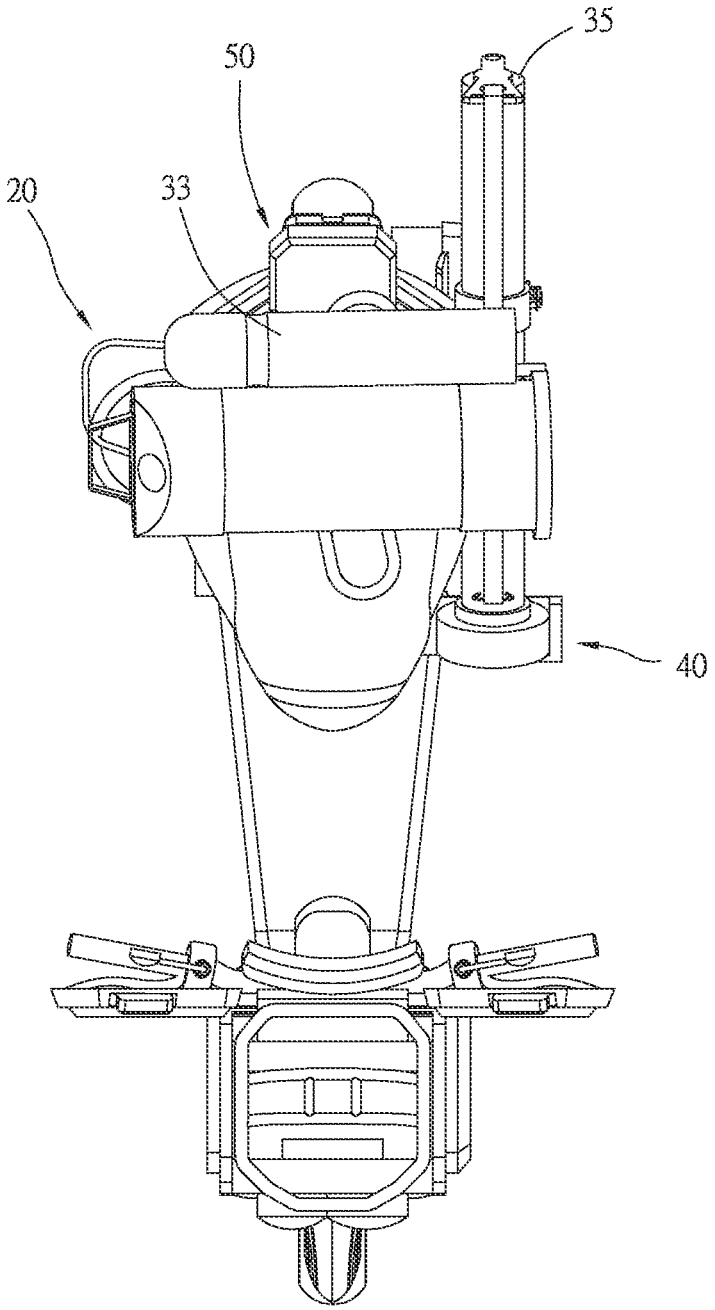
FIG. 2 is a top view of FIG. 1.

The applicant first explains here that throughout the specification, including the embodiments described below and the various claims in the scope of the patent application, the nouns related to directionality are based on the directions of the drawings listed in the brief description of the drawings. Secondly, in the embodiments and drawings to he introduced below, the same element numbers represent the same or similar elements or their structural features. Moreover, the detailed structure, characteristics, assembly or use, manufacturing and other methods of the present invention will he described in the detailed description of the subsequent embodiments. Of course, those with ordinary knowledge in the field of the present invention should. be able to understand that these detailed descriptions and the examples listed in the present invention are only used to support the explanation that the present invention can be implemented according to it, and are not intended to limit the patent scope of the application of the present invention.

Referring to FIGS. 1-6, a firefighting motorcycle 1 disclosed in the preferred embodiment of the present invention comprises a motorcycle body 10, a carrier device set 20, a firefighting equipment 30, and a fire extinguishing gun bracket 40. The carrier device set 20 is installed on the rear end of the motorcycle body 10, so that the firefighting equipment 30 can be loaded on the carrier device set 20, and the fire extinguishing gun bracket 40 is installed on one side of the motorcycle body 10.

In this embodiment, the motorcycle body 10 is a sports locomotive of the YAMAHA brand, of course, other brands can also be used, such as sports motorcycles manufactured by KYMCO, SYM, BMW, or HONDA. It is not used to limit the technical features that the present invention intends to claim. The motorcycle body 10 is pivotally equipped with a trunk cover 11.

Please refer to FIGS, 1-9, and the carrier device set 20 comprises a carrier 21, a long hollow bracket 23 and a hydraulic buffer 25. The carrier 21 is basically composed of an L-shaped first carrier component 211, an L-shaped second carrier component 212, and a long plate-shaped connecting member 213. The first carrier component 211 comprises a plane 211A, and the plane 211A of the first carrier component 211 is formed by a first end 211B with a larger width and a second end. 211C with a smaller width connected to the first end 211B. The plane 211A of the first carrier component 211 gradually tapers from the first end 211B of the larger width to the second end 211C of the smaller width. The second carrier component 212 comprises a plane 212A, and the plane 212A of the first carrier component 212 is formed by a first end 212B with a larger width and a second end 212C with a smaller width connected to the first end 212B. The plane 212A of the second carrier component 212 gradually tapers from the first end 212B of the larger width to the second end 212C of the smaller width. The two ends of the connecting member 213 respectively protrude toward the same side to form a first coupling portion 213A and a second coupling portion 213B, so that a concave portion 213C is formed between the first coupling portion 213A and the second coupling portion 213B. The first coupling portion 213A and the second coupling portion 213B at both ends of the connecting member 213 are respectively connected to the first end 211B of the plane 211A of the first carrier component 211 and the first end 212B of the plane 212A of the second carrier component 212 so that the carrier 21 as a whole conforms to the appearance of the rear end of the motorcycle body 10 and can be assembled on it. In addition, the plane 211A of the first carrier component 211 is protruded with two spaced protrusions 211D, and the upper end of any of the protrusions 211D is provided with a U-shaped supporting portion 211E. It is worth mentioning that the two supporting portions 211E can also be directly spaced on the plane 211A of the first carrier component 211. The first carrier component 211 is equipped with two fixing portions 211F for assembly and fixing on one side of the rear end of the motorcycle body 10. In addition, from the plane 212A of the second carrier component 212 and in the direction of the outer part 212G of the plane 212A, two separate mounting portions 212E are formed respectively. The positions of the two supporting portions 211E of the first carrier component 211 correspond to the U-shaped notches of the two mounting portions 212E of the second carrier component 212. The second carrier component 212 is equipped with two fixing portions 212F, which are assembled and fixed on the other side of the rear end of the motorcycle body 10, The long hollow bracket 23 is basically composed of a ring-shaped bottom 231, a U-shaped back rod 233 and two ring-shaped handles 235.

The two opposite ends of the U-shaped hack rod 233 are respectively connected to one side of the ring-shaped bottom 231, so that an accommodating space 234 is formed between the ring-shaped bottom 231 and the back rod 233. The positions of the two opposite ends of the back rod 233 close to the ring-shaped bottom 231 are respectively provided with an assembly portion 232, so that the two assembly portions 232 of the long hollow bracket 23 are respectively pivotally connected to the two mounting portions 212E on the plane 212A of the second carrier component 212. Preferably, the two ring-shaped handles 235 are respectively set on the two opposing rod portions of the back rod 233 of the long hollow bracket 23, and there is a concave arc-shaped hearing plate 237 provided between the two opposing rod portions of the back rod 233 of the long hollow bracket 23. It is worth mentioning that, in fact, only one ring handle 235 can he assembled on the back rod 233 of the long hollow bracket 23. Both ends of the hydraulic buffer 25 (such as a hydraulic buffer) are respectively pivotally connected to the connecting member 213 of the carrier 21 and the back rod 233 of the long hollow bracket 23. Preferably, there is a spring (not shown in the picture) embedded in the hydraulic buffer 25.

Figure 3:
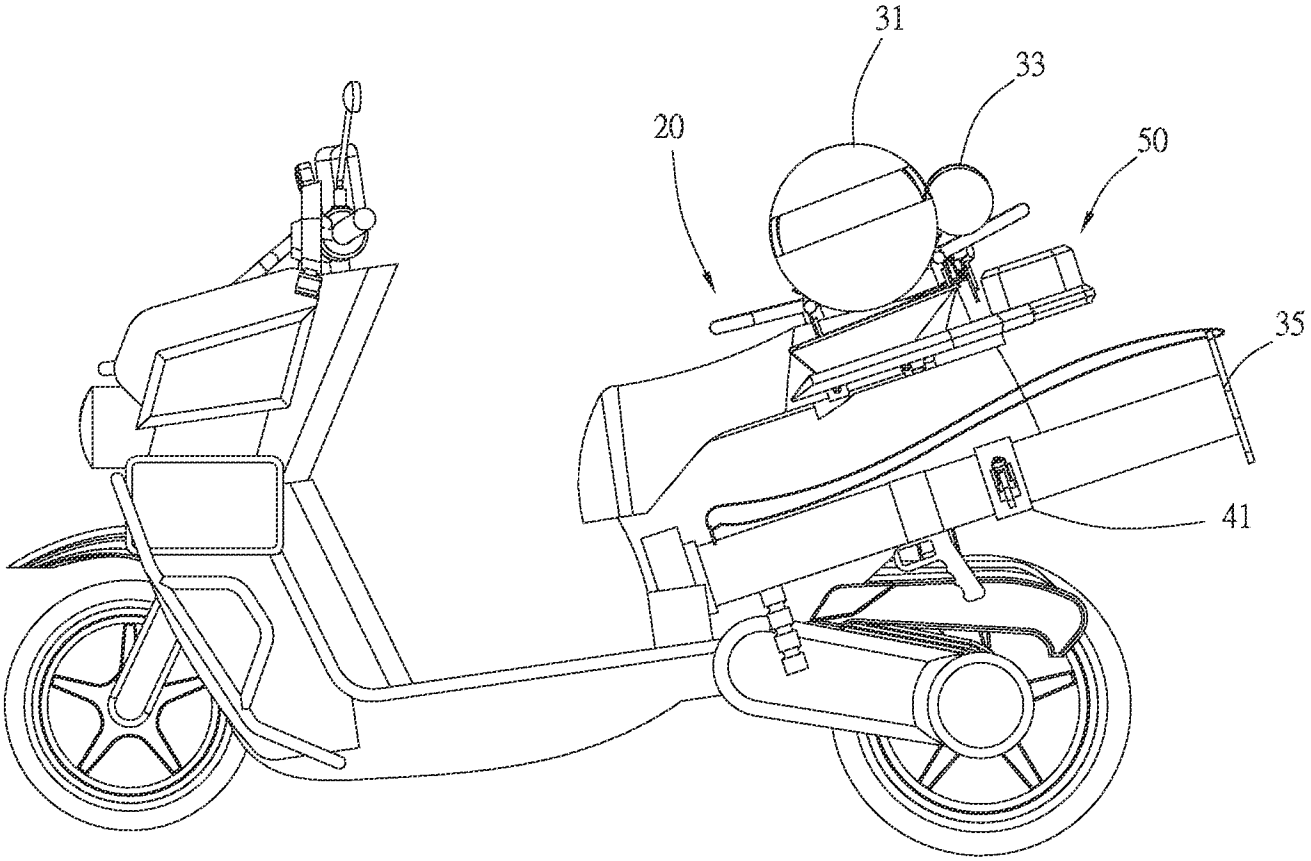
FIG. 3 is a side view of FIG. 1.
Figure 4:
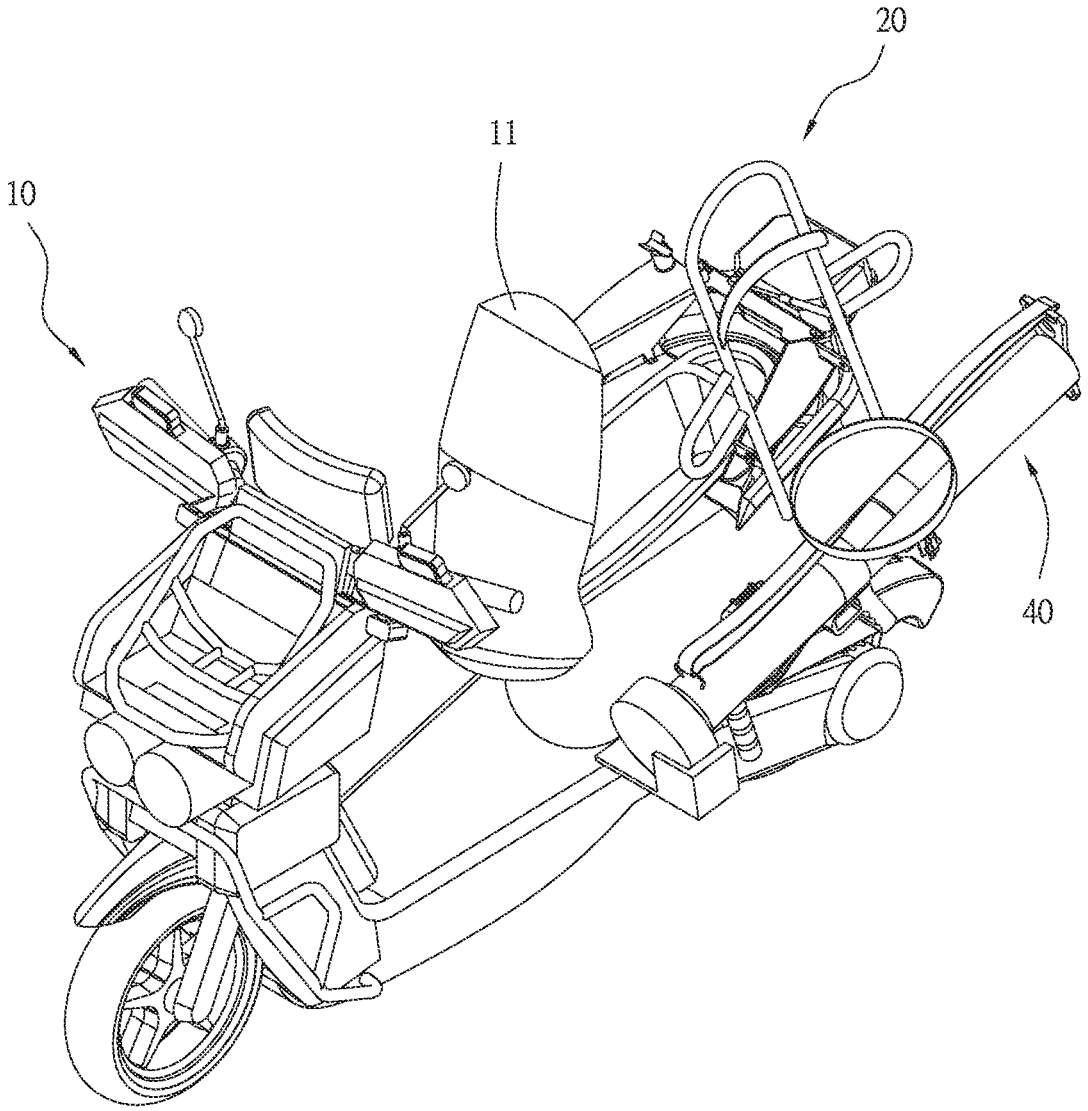
FIG. 4 is similar to FIG. 1, which is mainly to reveal that the firefighting motorcycle is in a state of use.
Figure 5:
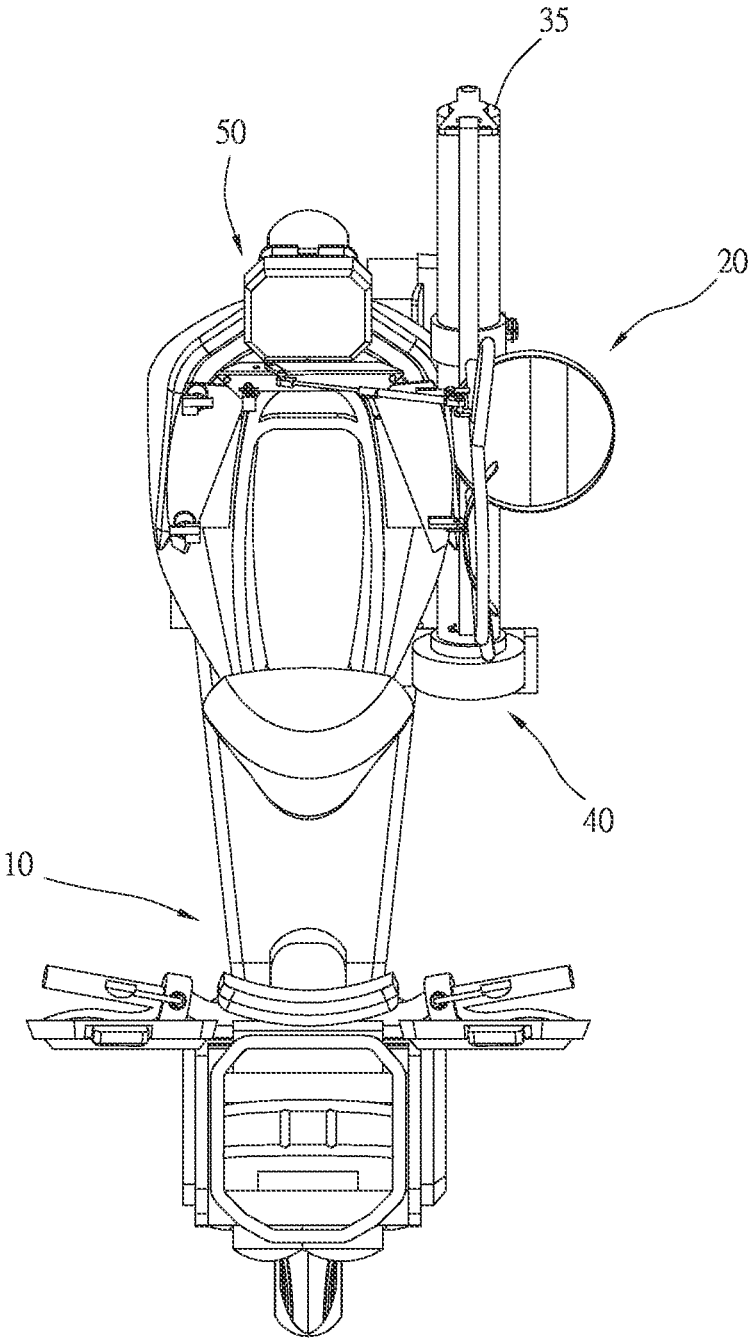
FIG. 5 is a top view of FIG. 4.
Figure 6:
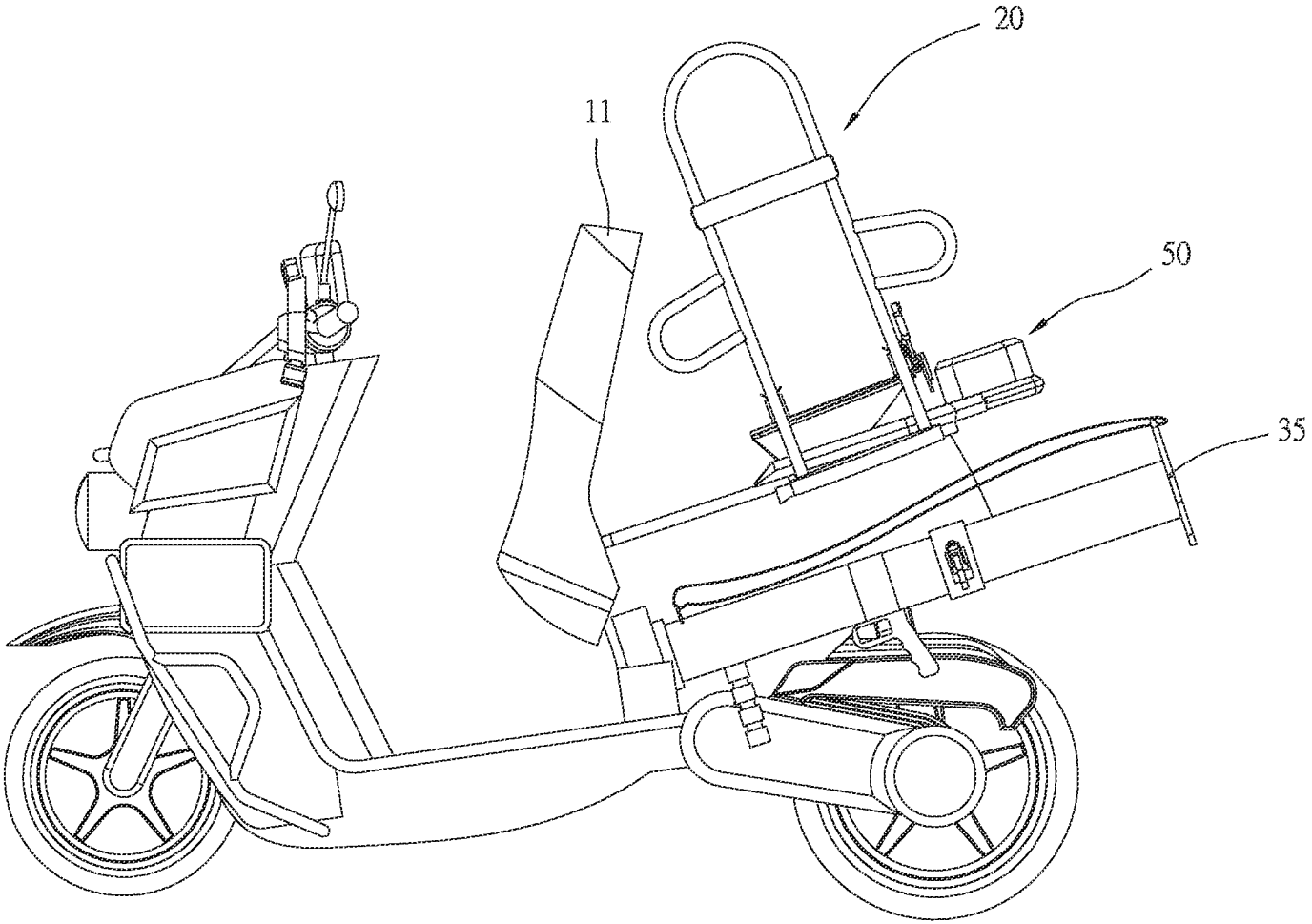
FIG. 6 is a side view of FIG. 4.
Figure 7:
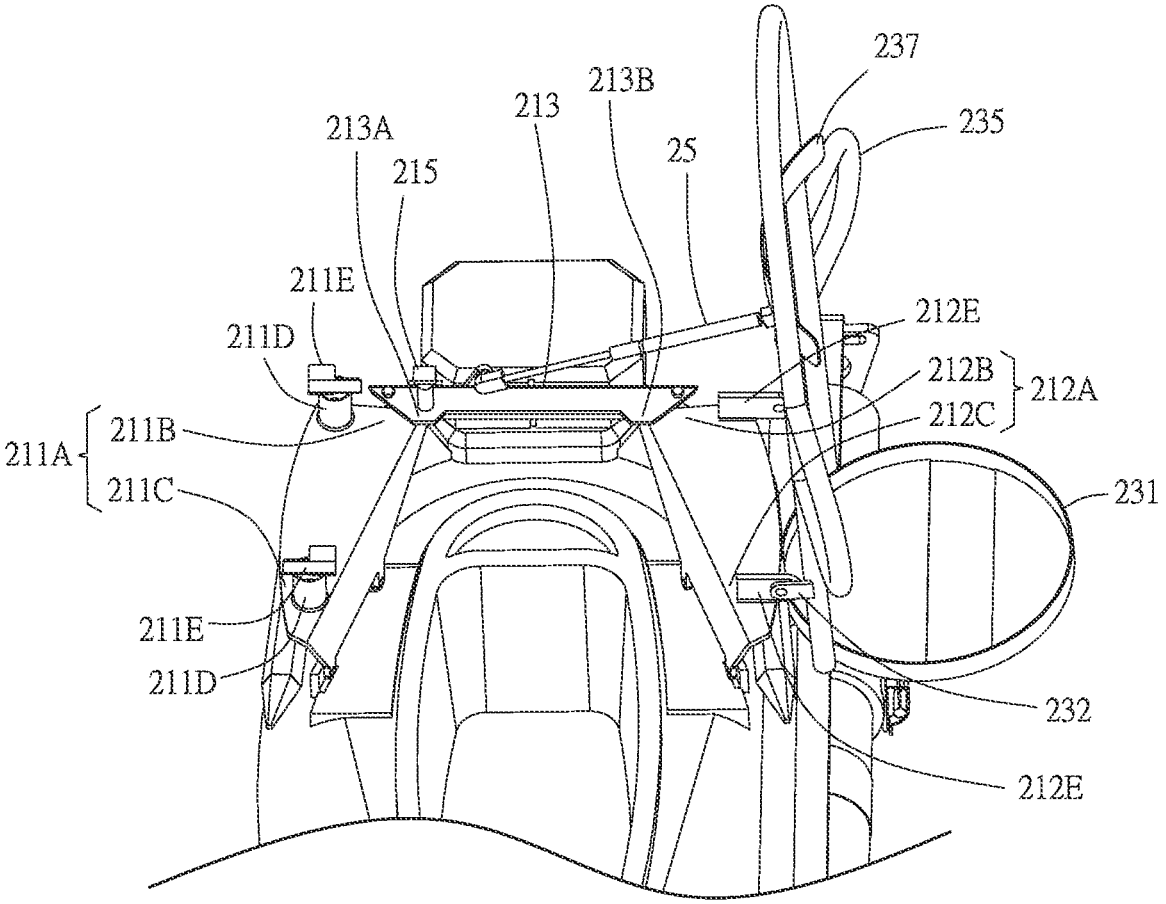
FIG. 7 is an enlarged view of a part of FIG. 4.
Figure 8:
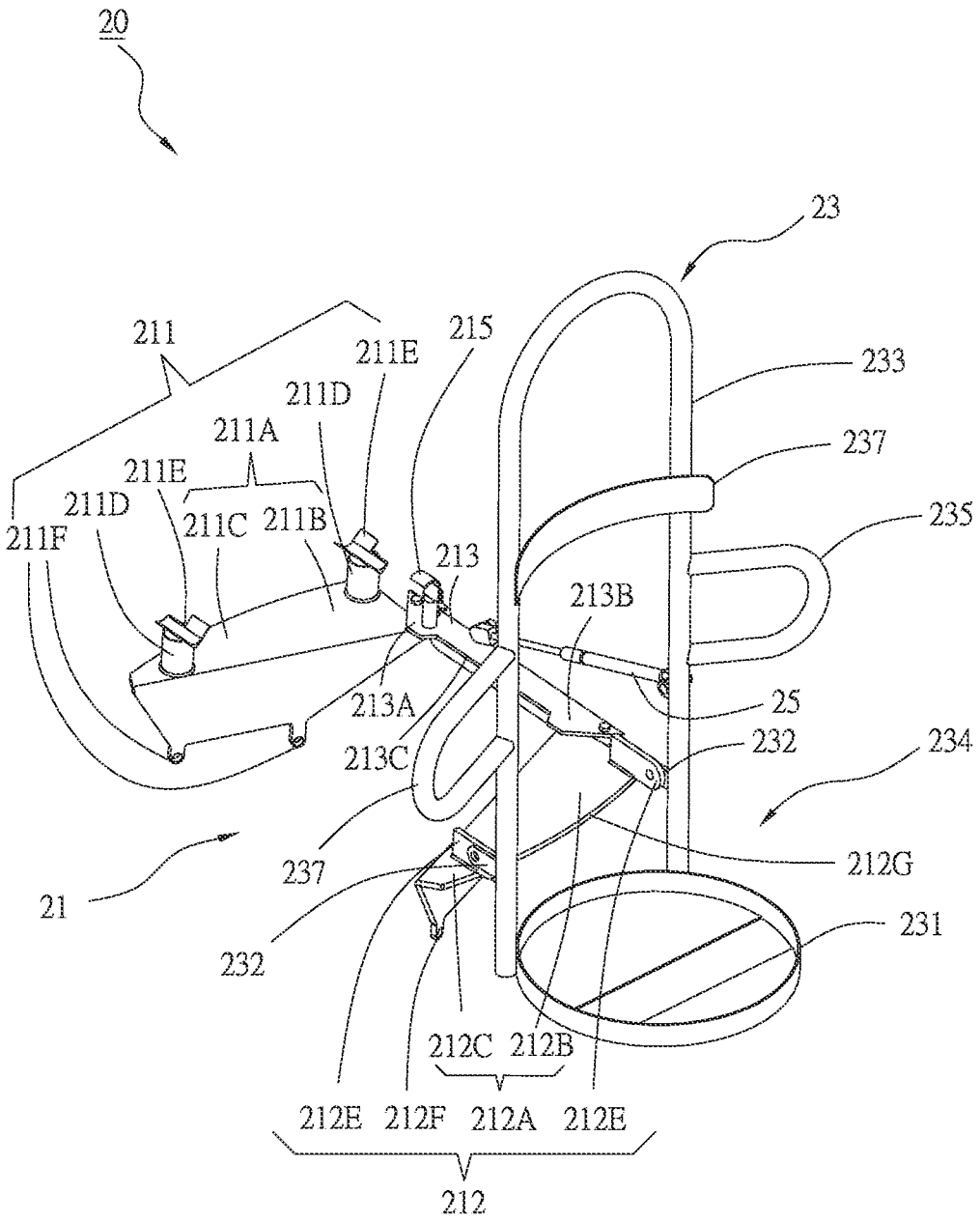
FIG. 8 is a schematic elevational view of part of the components of FIG. 4, mainly exposing a carrier device set presenting an upright state.
Figure 10:
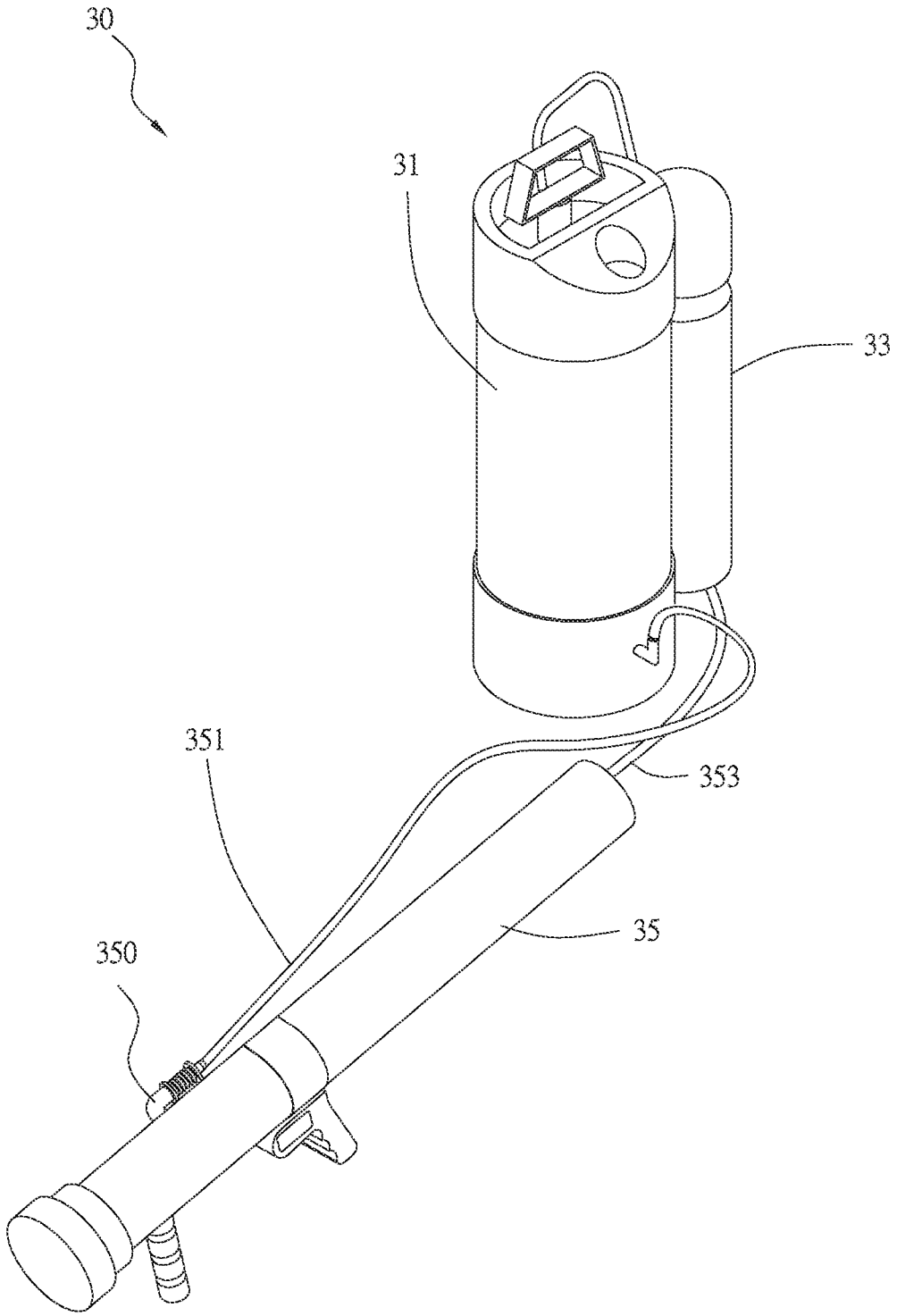
FIG. 10 is a schematic elevational view of part of the components of FIG. 1, mainly exposing a firefighting equipment.

Please refer to FIG. 1, FIG, 2, FIG. 3 and FIG. 10 together, and the firefighting equipment 30 comprises a water storage tank 31, a high-pressure gas cylinder 33 and a fire extinguishing gun 35. The high-pressure gas cylinder 33 is arranged on one side of the water storage tank 31, so that the fire extinguishing gun 35 is connected to the water storage tank 31 and the high-pressure gas cylinder 33 through two pipes 351 and 353, respectively. Preferably, if not in use, the two pipes 351 and 353 can be separated from the water storage tank 31, the high-pressure gas cylinder 33 and the fire extinguishing gun 35. It is worth mentioning that the fire extinguishing gun 35 disclosed in this embodiment is an example of a high-pressure atomized fire extinguishing gun, and the lire extinguishing gun 35 is further provided with a high-pressure connector 350, which is connected to the one ends of the pipes 351.

The above are the technical features of the firefighting motorcycle 1 and its components disclosed in the preferred embodiment of the present invention. Then, please refer to FIGS. 1 to 10 together to disclose the operation mode of the firefighting motorcycle 1 and its intended achievement effect.

Figure 9:
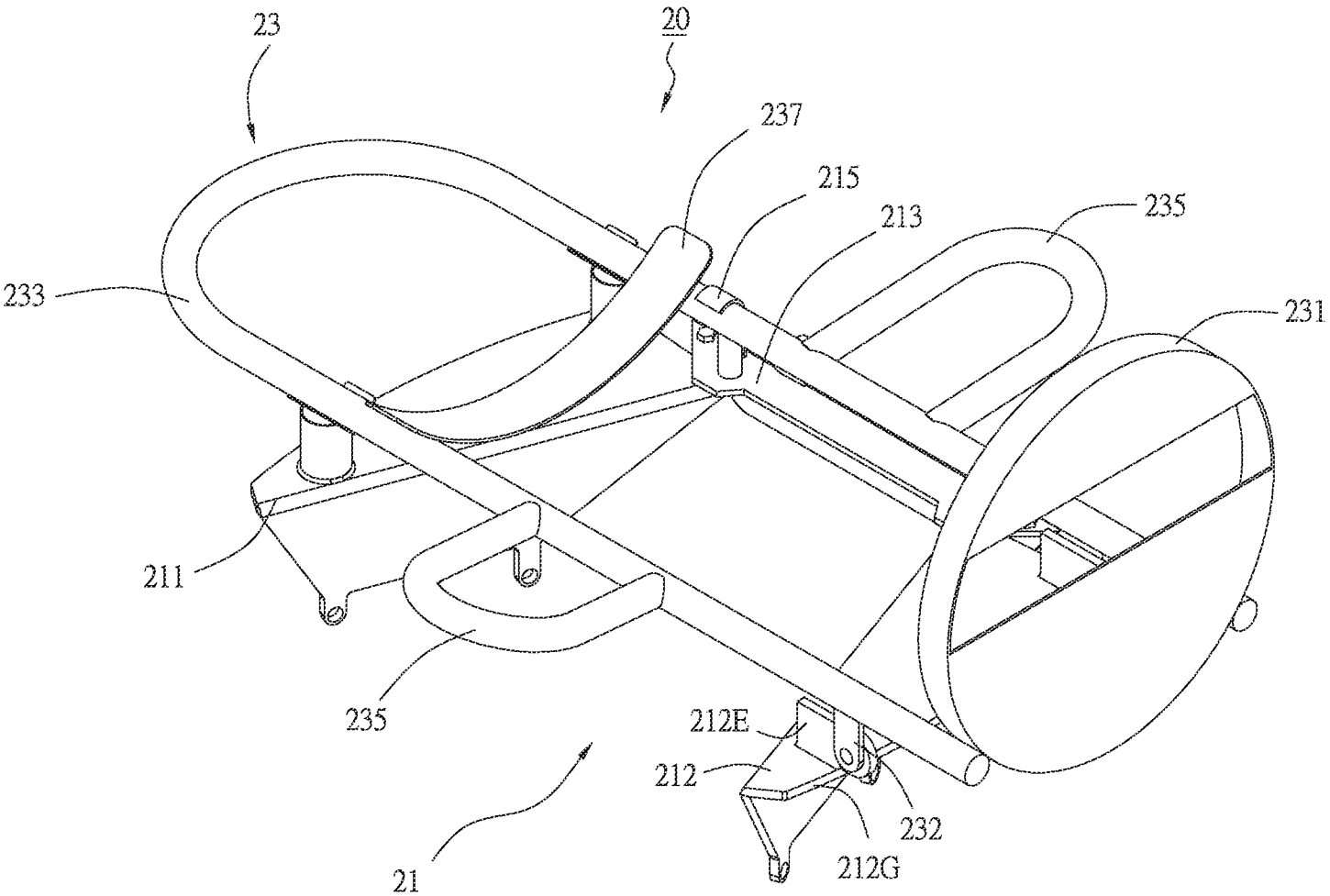
FIG. 9 is a schematic elevational view of part of the components of FIG. 4, mainly exposing the carrier device set in a downside state.

First of all, firefighters have to inspect the overall equipment before going out on mission. At this time, the two fixing portions 211F of the first carrier component 211 of the carrier 21 of the carrier device set 20 and the two fixing portions 212F of the second carrier component 212 are respectively assembled on the two sides of the rear end of the motorcycle body 10, so that the first carrier component 211, second carrier component 212 and the connecting member 213 of the carrier 21 surround the rear end of the motorcycle body 10. Preferably, the convex portion 213C of the connecting member 213 of the carrier 21 conforms to the shape of the trunk cover 11 of the motorcycle body 10 to achieve the effect of facilitating the pulling of the trunk cover 11 of the motorcycle body 10. Then, place the water storage tank 31 and high-pressure gas cylinder 33 of the firefighting equipment 30 in the accommodating space 234 formed by the long hollow bracket 23 of the carrier device set 20, and let the bottom of the water storage tank 31 be accommodated in the ring bottom 231 of the long hollow bracket 23, and let the tank body of the water storage tank 31 abut against the bearing plate 237 of the long hollow bracket 23. Preferably, as shown in FIG. 9, a fastening member 215 provided on the connecting member 213 of the carrier 21 can be fastened to the back rod 233 of the long hollow bracket 23 to fix the carrier 21 and the long hollow bracket 23 together. More preferably, the water storage tank 31 can be stably tied to the carrier 21 and the long hollow bracket 23 by a flexible strap (not shown in the figure). Finally, the fire extinguishing gun 35 of the firefighting equipment 30 is placed on the fire extinguishing gun bracket 40 installed on the side of the motorcycle body 10 and is in an approximately horizontal state. Preferably, a fastening member 41 provided on the fire extinguishing gun bracket 40 can be buckled and fixed to the fire extinguishing gun 35 to avoid falling. The two pipes 351 and 353 can be separately released from the water storage tank 31, the high-pressure gas cylinder 33, the fire extinguishing gun 35 and the high-pressure connector 350, and placed in the vehicle box of the motorcycle body 10.

Then, please refer to FIGS. 4 to 10 together. When the firefighter is out of mission and rides the firefighting motorcycle 1 to the scene of the fire, the firefighter will first park the motorcycle body 10 completely, and then unlock the fastening member 215 that was originally buckled on the back rod 233 of the long hollow bracket 23. Pull out one of the ring-shaped handles 235 so that the long hollow bracket 23 that supports the water storage tank 31 of the firefighting equipment 30, and the high-pressure gas cylinder 33 is displaced from the initial position to a position close to the upright position. Preferably, in order to allow firefighters to erect the long hollow bracket 23 more effortlessly, the spring force originally set in the hydraulic buffer 25 is released, so that the hydraulic buffer 25 is stretched toward the back rod 233 of the long hollow bracket 23 until the two ends of the hydraulic buffer 25 are respectively stopped against the connecting member 213 of the carrier 21 and the back rod 233 of the long hollow bracket 23. Then, the firefighter can take out the two pipes 351, 353 originally placed in the vehicle box of the motorcycle body 10 and take out the fire extinguishing gun 35 from the fire extinguishing gun bracket 40 on the side of the motorcycle body 10, and then make the fire extinguishing gun 35 and the high-pressure connector 350 communicate with the water storage tank 31 and the high-pressure gas cylinder 33 through the two pipes 351 and 353, respectively. At this point, the firefighter can unhook the straps originally tied to the water storage tank 31, the carrier 21 and the long hollow bracket 23, and carry the water storage tank 31 and the high-pressure gas cylinder 33 on the back to carry out the fire rescue. In addition, if the water storage tank 31 and high-pressure gas cylinder 33 of the firefighting equipment 30 carried by the long hollow bracket 23 are to be assigned to the initial position again, a gentle and smooth tilting effect is achieved through the hydraulic buffer 25, until the back rod 233 of the long hollow bracket 23 is straddled again on the two supporting portions 211E on the plane 211A of the first carrier component 211. It is worth mentioning that, because the trunk cover 11 of the motorcycle body 10, the larger width first end 211B of the first carrier component 211 of the carrier 21 and the larger width first end 212B of the second carrier component 212 form a larger bearing surface, heavy equipment such as the water storage tank 31 and high-pressure gas cylinder 33 of the firefighting equipment 30 carried by the long hollow bracket 23 of the carrier device set 20 will achieve a more stable placement effect, In addition, please refer to FIGS. 2 to 7 together. A warning light set 50 can be set on the outside of the connecting member 213 of the carrier device set 20 of the motorcycle body 10 of the firefighting motorcycle 1, so that the firefighter can turn on the warning light set 50 and start the warning sound during the mission to achieve the effect of clearly informing other passers-by or vehicles to actively dodge or give way, so as to facilitate the smooth arrival at the fire scene.

What is claimed is:

1. A carrier device set (20), comprising:

a carder (21) comprising a first carrier component (211), a second carder component (212) and a connecting member (213), said first carrier component (211) comprising a plane (211A), and the said plane (211A) of said first carrier component (211) being formed by a first end (211B) with a larger width and a second end (211C) with a smaller width connected to the said first end (211B), the said plane (211A) of said first carrier component (211) gradually tapering from the said first end (211B) of the larger width of the said plane (211A) of said first carrier component (211) to the said second end (211C) of the smaller width of the larger width of the said plane (211A) of said first carrier component (211), said second carrier component (212) comprising a plane (212A), and the said plane (212A) of said second carrier component (212) being formed by a first end (212B) with a larger width and a second end (212C) with a smaller width connected to the said first end (212B), the said plane (212A) of said second carrier component (212) gradually tapering from the said first end (212B) of the larger width of the said plane (212A) of said second carrier component (212) to the said second end (212C) of the smaller width of the larger width of the said plane (212A) of said second carrier component (212), said connecting member (213) having two opposite ends thereof respectively protruding toward one same side to form a first coupling portion (213A) and a second coupling portion (213B), said first coupling portion (213A) and said second coupling portion (213B) of said connecting member (213) being respectively connected to the said first end (211B) of the said plane (211A) of said first carrier component (211) and the said first end (212B) of the said plane (212A) of said second carrier component (212), the said plane (211A) of said first carrier component (211) being provided with two supporting portions (211E) at intervals, said second carrier component (212) further comprising two mounting portions (212E) protruded from the plane (212A) thereof; wherein said connecting member (213) of said carrier (21) further comprises a concave portion (213C) provided between said first coupling portion (213A) and said second coupling portion (213B);

a long hollow bracket (23) composed of a ring-shaped bottom (231), a U-shaped back rod (233) and a handle (235), said U-shaped back rod (233) having two opposite ends thereof respectively connected to one side of said ring-shaped bottom (231), so that an accommodating space (234) is formed between said ring-shaped bottom (231) and said U-shaped back rod (233), the positions of the two opposite ends of said U-shaped back rod (233) close to said ring-shaped bottom (231) being respectively provided with an assembly portion (232), said two assembly portions (232) of said long hollow bracket (23) being respectively pivotally connected to said two mounting portions (212E) on the said plane (212A) of said second carrier component (212), said handle (235) being set on said U-shaped back rod (233); wherein said carrier (21) further comprises a fastening member (215) provided at said connecting member (213) and fastened to said U-shaped back rod (233) of said long hollow bracket (23); and a hydraulic buffer (25), said hydraulic buffer (25) having two opposite ends thereof respectively pivotally connected to said connecting member (213) of said carrier (21) and said U-shaped back rod (233) of said long hollow bracket (23).

2. The carrier device set (20) as claimed in claim 1, wherein said first carrier component (211) of said carrier (21) further comprises two protrusions (211D) protruding from the plane (211A) thereof, said two supporting portions (211E) are respectively arranged on said two protrusions (211D); said two supporting portions (211E) of said first carrier component (211) respectively correspond to the positions of said two mounting portions (212E) of said second carrier component (212).

3. The carrier device set (20) as claimed in claim 2, wherein said U-shaped back rod (233) of said long hollow bracket (23) comprises a bearing plate (237) provided between two opposite rod portions thereof.

4. A firefighting motorcycle (1), comprising:

a motorcycle body (10);

a carrier device set (20) as claimed in claim 3, said first carrier component (211), said second carrier component (212) and said connecting member (213) of said carrier device set (20) surround and are assembled at a rear end of said motorcycle body (10);

a firefighting equipment (30) comprising a water storage tank (31), a high-pressure gas cylinder (33) and a fire extinguishing gun (35), said high-pressure gas cylinder (33) being arranged on one side of said water storage tank (31), said fire extinguishing gun (35) being connected to said water storage tank (31) and said high-pressure gas cylinder (33) through two pipes (351, 353) respectively, said water storage tank (31) and said high-pressure gas cylinder (33) being set in said accommodating space (234) of said long hollow bracket (23) of said carrier device set (20), so that the bottom of said water storage tank (31) is accommodated in the bottom (231) of said long hollow bracket (23); and a fire extinguishing gun bracket (40) set at one side of said motorcycle body (10) to hold said fire extinguishing gun (35) of said firefighting equipment (30).

5. The firefighting motorcycle as claimed in claim 4, wherein said first carrier component (211) of said carrier device set (20) comprises two fixing portions (211F) assembled on one side of a rear end of said motorcycle body (10); said second carrier component (212) of said carrier device set (20) comprises two fixing portions (212F) assembled on an opposite side of the said rear end of said motorcycle body (10).

6. The firefighting motorcycle as claimed in claim 5, further comprising a warning light set (50) mounted outside said connecting member (213) of said carrier device set (20).

7. The carrier device set (20) as claimed in claim 1, wherein said U-shaped back rod (233) of said long hollow bracket (23) comprises a bearing plate (237) provided between two opposite rod portions thereof.

8. A firefighting motorcycle (1), comprising:

a motorcycle body (10):

a carrier device set (20) as claimed in claim 7, said first carrier component (211), said second carrier component (212) and said connecting member (213) of said carrier device set (20) surround and are assembled at a rear end of said motorcycle body (10);

a firefighting equipment (30) comprising a water storage tank (31), a high-pressure gas cylinder (33) and a fire extinguishing gun (35), said high-pressure gas cylinder (33) being arranged on one side of said water storage tank (31), said fire extinguishing gun (35) being connected to said water storage tank (31) and said high-pressure gas cylinder (33) through two pipes (351, 353) respectively, said water storage tank (31) and said high-pressure gas cylinder (33) being set in said accommodating space (234) of said long hollow bracket (23) of said carrier device set (20), so that the bottom of said water storage tank (31) is accommodated in the bottom (231) of said long hollow bracket (23); and a fire extinguishing gun bracket (40) set at one side of said motorcycle body (10) to hold said fire extinguishing gun (35) of said firefighting equipment (30).

9. The firefighting motorcycle as claimed in claim 8, wherein said first carrier component (211) of said carrier device set (20) comprises two fixing portions (211F) assembled on one side of a rear end of said motorcycle body (10); said second carrier component (212) of said carrier device set (20) comprises two fixing portions (212F) assembled on an opposite side of the said rear end of said motorcycle body (10).

10. The firefighting motorcycle as claimed in claim 9, further comprising a warning light set (50) mounted outside said connecting member (213) of said carrier device set (20).

* * * * *